United States Patent [19]

Weller

[11] 3,958,468

[45] May 25, 1976

[54] TOGGLE WRENCH HAVING PRESSURE CALCULATOR MEANS

[76] Inventor: Robert W. Weller, P.O. Box 398, Lomita, Calif. 90717

[22] Filed: June 13, 1969

[21] Appl. No.: 832,908

[52] U.S. Cl. ..... 81/368

[51] Int. Cl. ..... B25b 7/12

[58] Field of Search ..... 81/367–380, 81/5.1; 269/201, 228

[56] References Cited

UNITED STATES PATENTS 2,598,650 5/1952 Smith et al. ..... 81/369

*Primary Examiner*—Robert C. Riordon

*Assistant Examiner*—Roscoe V. Parker, Jr.

[57] ABSTRACT

An improvement in the pressure selector of a toggle type wrench, provides a visual means of selecting and adjusting the amount or degree of pressure that will be applied to the workpiece during clamping, thus reducing the possibility of damaging the workpiece by applying to much pressure.

3 Claims, 4 Drawing Figures

TOGGLE WRENCH HAVING PRESSURE CALCULATOR MEANS

This invention relates generally to workpiece clamping devices such as toggle wrenches having the conventional or manual screw adjustment for jaw control and toggle wrenches having automatic or self-adjustment jaw control means. More particularly it is an object of this invention to provide a pressure calculator means that indicates the pressure applied to the workpiece during clamping.

A further object of the present invention is to provide an improvement in the pressure selector of the conventional type toggle wrenches such as shown in U.S. Pat. Nos. 2,514,130 and 2,705,899 and in the automatic or self-adjusting toggle wrenches such as shown in U.S. Pat. Nos. 3,116,656 and 3,262,343 and more specifically it is an object of this invention to provide a means of selecting and adjusting the wrench to a predetermined pressure upon clamping.

A further object of the invention is to provide a pressure calculator means that will reduce or eliminate crimping, marring, and squeeze-mark damage to the wordpiece by applying a known amount of jaw pressure.

A further object of my pressure calculator is to provide a very useful visual pressure selector improvement in toggle type wrenches that adds very little, if any, to the cost of manufacturing because of its simplicity, but does add much value to the wrench in all-around versatility.

These and other objects and advantages of the invention, as well as the details of an illustrative embodiment, will be more fully understood from the following detailed description of the drawing, in which.

Figure 1:
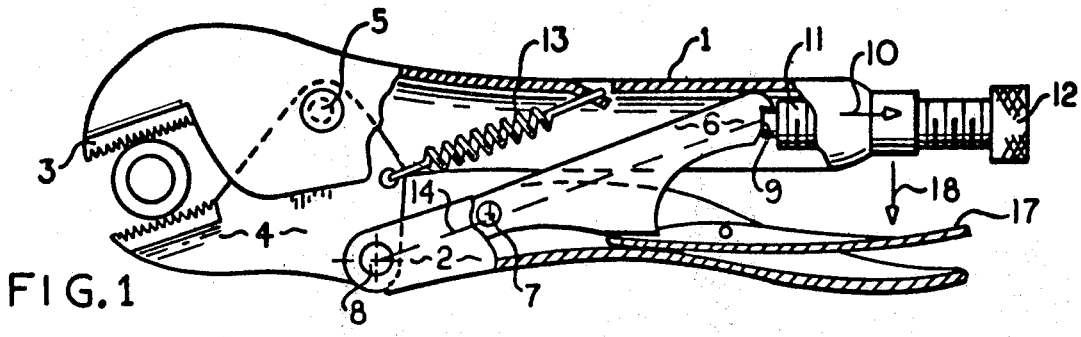
FIG. 1 is a side elevation with the conventional toggle wrench in work clamping position.

The general construction of the toggle wrench employing the pressure calculator means is as follows. Refering to FIG. 1 and FIG. 2 The toggle wrench comprises a pair of handles, a fixed handle 1 and a movable handle 2. The fixed jaw 3 is an integral part of handle 1, with a movable jaw 4 attached to handle 1 at pivot 5. Movable handle 2 and toggle link 6 pivoted at pivot 7 make-up the toggle joint. One end of handle 2 is attached to movable jaw 4 at pivot 8 leaving other end of handle 2 free for movement. Other end of toggle link 6 is engaged at point 9 on the end of adjustment screw 11. The jaw opening and pressure is controlled manually by the adjustment screw 11 shown in FIG. 1 and FIG. 2. The wrench using the self-adjusting means shown in FIG. 3 will be discussed in more detail later. Spring 13 pulls the movable jaw 4 open when movable handle 2 is moved outwardly from fixed handle 1 as indicated by arrow 18 or when adjustment screw 11 is moved in the direction indicated by arrow 10. Broken center line 14, in FIG. 1, shows the toggle joint in the locked position with pivot 7 past the center line of pivot 8 and engaged point 9.

Figure 2:
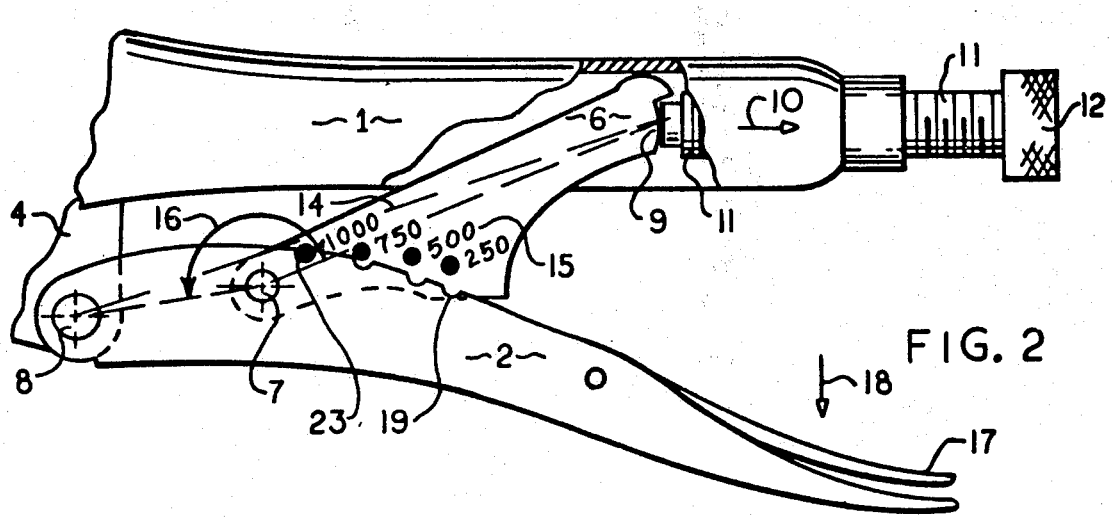
FIG. 2 is a fragmentary side elevation showing the pressure calculator with the tool in the unlocked position.

Refering to FIG. 2, to adjust the jaws and lock the conventional type wrench on the workpiece the handles are seperated slightly as indicated by arrow 18 and the adjustment screw 11 is turned by knob 12 until the jaws are adjusted to the size of the workpiece. When the jaws are pressing on the workpiece and when the movable handle 2 is open slightly the toggle joint will have a small angle as shown at 16. When pressure is applied to the handles the pressure is put on the toggle joint pivot 7 causing the joint to straighten as shown by broken line 14 in FIG. 2. As the joint straightens the outward pressure is transmitted to the movable jaw 4 at pivot 8 as the other end of the toggle link 6 is blocked from movement at point 9 on the adjustment screw 11 in the fixed handle 1. The jaws of the wrench are unlocked by pressing on the easy release lever 17 in the direction indicated by arrow 18.

Figure 4:
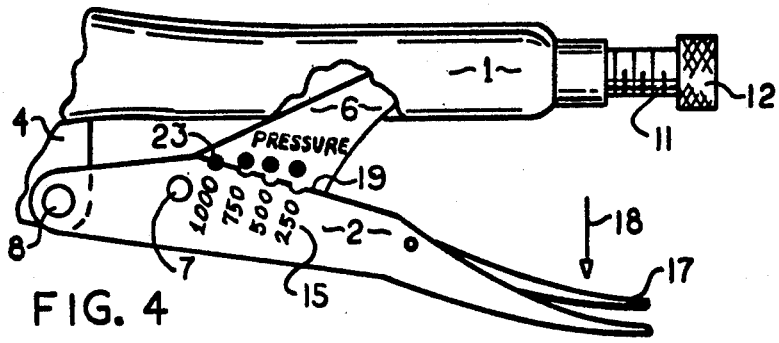
FIG. 4 is a fragmentary side elevation showing the pressure calculator with the pressure rating scale stamped on the handle.

Preferably when the toggle wrench employing the pressure calulator means is fabricated the pressure rating scale 15 should be stamped into the metal on either the handle 2 as shown in FIG. 4 or stamped into the toggle link 6 as shown in FIG. 2. There are many different types of rating scales that can be used on the wrench. For example, besides a pound-scale the scale can be rated in a ton-scale such as 1 ton, ¾ ton, ½ ton and ¼ ton. Also a general pressure scale could be used such as hard, medium and soft material or high, medimum and low with different scales stamped, etched or imprinted on either side of the tool.

During the clamping process the pressure calculator operates as follows; refering to FIG. 2, to adjust the jaws that are to be applied to the workpiece the adjustment screw 11 is moved either inwardly or outwardly of handle 1, with the handles in the closed position, until the jaws accomodate the size of the workpiece. Then by aligning and holding handles 1 and 2 firmly to maintain setting at sight notch of indicator edge 19 of handle 2 with the pressure mark as shown at 23, which indicates 1,000 pounds pressure, the adjustment screw knob 12 is turned clockwise until adjustment screw 11 is finger tight and the jaws are pressing on the workpiece. Then full pressure is applied to handles 1 and 2 of the wrench thereby locking onto the workpiece at the pressure indicated on the rating scale.

The toggle joint angle 16 in FIG. 2 is what determinds the pressure applied to the movable jaw 4. During lock-up of the wrench the smaller the angle in degrees of the toggle joint angle 16 the higher the pressure applied to the movable jaw 4.

Figure 3:
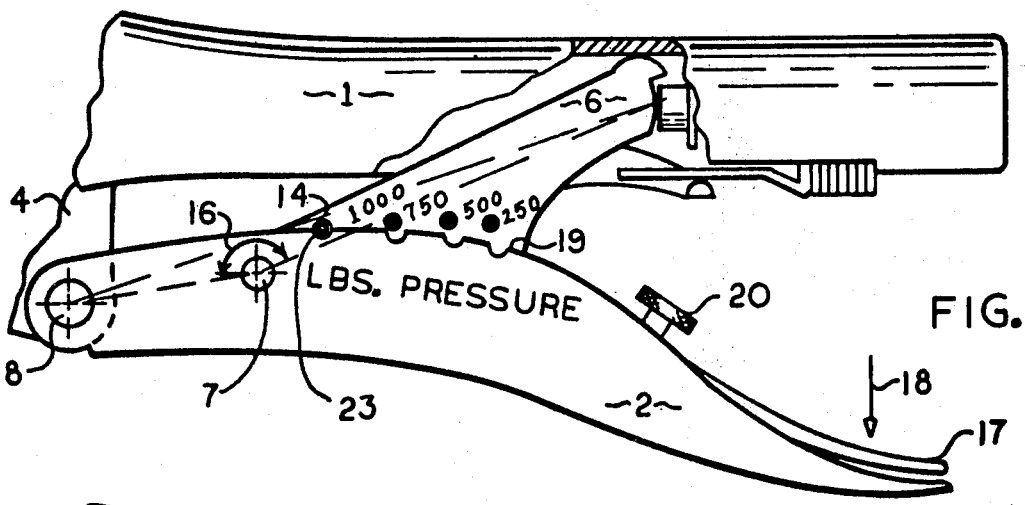
FIG. 3 is a fragmentary side elevation showing the pressure calculator with the pressure rating scale carried on the toggle link of the self-adjusting toggle wrench in the unlocked position.

FIG. 3 illustrates one type of automatic or self-adjusting toggle wrench with the pressure calculator means. The self-adjusting wrench shown does not have the adjustment screw in the end of the fixed handle 1 as shown in FIG. 1 and FIG. 2. The means for blocking movement of the toggle link 6 is actuated automatically upon the closing of the handles. Many wrenches of the automatic type have a pressure adjustment screw that, after adjustment, maintains the same jaw pressure on any size object that the wrench is clamped on.

In FIG. 3 the pressure adjustment screw 20 is carried on the movable handle 2. The pressure calculator operates in much the same way as the conventional wrench previously discussed and illustrated in FIG. 1 and FIG. 2. When selecting a pressure setting on the self-adjusting wrench the handles 1 and 2 are opened and closed several times while adjusting the pressure screw 20 until the indicator edge 19 of movable handle 2 stops on the desired pressure marking. Then full squeezing pressure is applied to the handles and the jaws lock onto the workpiece at the pressure indicated on the rating scale.

In the preceding description and drawing I have illustrated and described my pressure calculator means employed on one type of conventional toggle wrench and on one type self-adjusting toggle wrench. However, it should be understood that my pressure indicator means can be incorporated into various types of toggle wrenches, conventional or self-adjusting and the invention may be employed whether or not any of the various easy release lever mechanisms are used.

I claim:

1. A toggle wrench comprising the combination of a first handle provided with a fixed jaw, a movable jaw mounted on said first handle, a toggle comprising a channel shaped second handle lever pivotally secured at one end with said movable jaw and a toggle link pivotally attached at one end in the channel of said second handle lever between its ends and at its other end engaged with a variable abutment means carried by said first handle, and a pressure calculator means for determining the amount of pressure that will be exerted on the workpiece, said pressure calculator means comprising in combination a pressure rating scale and indicator, said pressure rating scale and said indicator being arranged for translating the angle of said second handle in relation to said toggle link into known units of pressure and being operable during clamping of said toggle wrench.

2. The device as defined in claim 1 in which said pressure ratings are carried on the said second handle or said toggle link.

3. The device as defined in claim 1 in which indicator for said pressure ratings comprises sight notches on inside edge of said second handle.

* * * * *